US005934525A

United States Patent [19]

Blanchard

[11] Patent Number: 5,934,525

[45] Date of Patent: Aug. 10, 1999

[54] INFINITELY ADJUSTABLE LOCKING GARMENT HANGER

[75] Inventor: Russell O. Blanchard, Zeeland, Mich.

[73] Assignee: Batts, Inc., Zeeland, Mich.

[21] Appl. No.: 08/934,976

[22] Filed: Sep. 22, 1997

[51] Int. Cl.[6] ..... A47G 25/48

[52] U.S. Cl. ..... 223/96; 223/85; 223/93

[58] Field of Search ..... 223/85, 96, 95, 223/93, 91, 90; 211/113; D6/326, 323

[56] References Cited

U.S. PATENT DOCUMENTS

| | | | |
|---|---|---|---|
| 2,473,408 | 6/1949 | Alkin | 223/96 |
| 2,546,717 | 3/1951 | Beetlestone et al. | 223/96 |
| 4,746,039 | 5/1988 | Batts et al. | 223/96 |
| 4,878,276 | 11/1989 | Morrish et al. | 223/96 |
| 5,072,866 | 12/1991 | Kolton et al. | 223/96 |
| 5,289,956 | 3/1994 | Petrou | 223/96 |
| 5,398,854 | 3/1995 | Blanchard | 223/96 |

*Primary Examiner*—Bibhu Mohanty
*Attorney, Agent, or Firm*—Baker & McKenzie

[57] ABSTRACT

A garment hanger is provided with an elongated body member having linear surfaces so that clamp assemblies may be slid, by hand applied pressure, along the body member to desired locations, thereby providing a garment hanger of infinitely adjustable width within its working range and thus reducing the number of stockkeeping units to one, the hanger and clamp assemblies being so contoured that the clamp assemblies may be easily slid along the body member, the components being so contoured that the clamp assemblies always hang vertically, thus always presenting an impression of a neat, uncluttered appearance which makes a maximum favorable impression on the eye of a potential purchaser.

10 Claims, 5 Drawing Sheets

110
111
112
113
114
115
116
118
119
120
121
122
124
125
126
127
128
129
130
132
133
134
135
136
137
140
11

INFINITELY ADJUSTABLE LOCKING GARMENT HANGER

This invention relates generally to garment hangers especially adapted for the display and storage of garments in retail outlets and specifically to a single hanger which is capable of displaying garments which vary in width from small to large whereby, from the manufacturer's and retailer's standpoint, only a single stockkeeping unit is required, thereby eliminating the need to provide hangers of discrete lengths to accommodate garments of different hang widths.

BACKGROUND OF THE INVENTION

In the highly competitive garment manufacturing and retailing environment which exists today and, so far as can be predicted, far into the future, it is becoming more and more urgent for the manufacturer and retailer of garments to cut costs to the maximum extent possible to the end that the final price to the consumer be as low as possible. Garment hangers are a significant cost item in the manufacture, sale, and display of garments and hence pose the potential for cost reduction if increased standardization of them can be achieved. Unfortunately, garment hangers, to the present time, as a practical matter in the marketplace, have not evolved to a one size fits all product. This is due largely to the practical reason that the size range of garments is today so wide that no practical method or structure has been evolved to display, on a single stockkeeping hanger unit, a girls/ladies size 5 brief and mens size 54 slacks. As a consequence the retailer and the garment manufacturer have had to provide a plurality of different sized, though similarly contoured, hangers for the wide range of garment sizes intended to be displayed thereon. Thus it is current practice for a garment hanger manufacturer to offer a pinch clip garment hanger for use by the garment manufacturer and the retailer in several sizes of which a family of hangers consisting of an eight inch, a ten inch and a twelve inch hanger are representative. Each member of said family of hangers has a hook, a body or suspension bar, and a pair of clamps, one at each end of the suspension bar. While the hooks and clamps may be identical from hanger size to hanger size, the suspension bar is not, and hence three stockkeeping units are required to accommodate the differing sizes of garments offered to the consumer. Thus the hanger manufacturer has a mold cost, with respect to the body or suspension bar at least, which is three times greater than if a single size hanger could be manufactured and offered to the garment manufacturer and the retailer. The differing sizes present inventory control problems, production problems, as when one of the three molds breaks and hence an order cannot be filled, and increased costs in the form of providing an overage supply of three different size products to handle unanticipated excess demand as contrasted to a single overage supply if only one size hanger need be provided. These costs, and others associated with multiple stockkeeping units, are passed to the garment manufacturer and then to the retailer. And of course the garment manufacturer faces the problem of managing three stockkeeping units instead of one together with further costs associated with handling and moving hung garments on multiple sizes of hangers.

In addition to the factors mentioned above, there is a need for the combination of a garment and such a hanger which presents a neat, uncluttered appearance to the eye of a potential purchaser in a retail outlet. Specifically, there is a need for a hanger in which the pair of clamps hang absolutely vertical on all sizes of garments from the ladies'size 5 briefs to the men's size 54 slacks. Further, it is important that, in addition to hanging vertically so as to present a neat, uncluttered appearance to the eye, the size of the jaw opening be maximized so that bulky garments may be easily accommodated.

In summary, there is thus a need for a single size garment hanger which can easily, safely and economically serve as the storage, transporting and display structure for garments of a wide variety of sizes which, at the same time, provides a neat appearance to the eye of a potential purchaser when he views a garment hung on said hanger.

SUMMARY OF THE INVENTION

The invention consists of a garment hanger assembly having single size hanger body from which a pair of biased clamp assemblies are suspended, one clamp assembly at each end portion of the hanger body, said clamp assemblies being easily slidable toward and away from one another or in the same direction by simple, non-strenuous hand applied pressure by a user, whereby a single garment hanger assembly, and thereby a single stockkeeping unit, may be used by the garment manufacturer and retailer to store, transport, and display a wide variety of garment sizes. The invention further includes the use of different styles of clamp assemblies from hanger to hanger, or even on the same hanger if required, such as pad type grippers, toothed grippers, etc. In addition, the hanger is extremely versatile in the sense that not only may different styles of clamp assemblies be accommodated, but any desired sizer system may be incorporated into the hanger assembly.

BRIEF DESCRIPTION OF THE DRAWING

The invention is illustrated more or less diagrammatically in the accompanying drawing wherein

FIGS. 7–18 are views of an alternative embodiment of the garment hanger of this invention of which FIG. 7 is a perspective view;

FIG. 8 is a side elevation;

FIG. 9 is a top plan;

FIG. 10 is a bottom plan;

FIG. 11 is a section taken substantially along the line 11—11 of FIG. 8;

FIG. 12 is a right end view showing the clamp in the unloaded, closed position;

FIG. 13 is a right end view showing the clamp in the maximum, open, position preparatory to receiving a garment to be hung;

FIG. 14 is a front view to an enlarged scale of a pad type clamp half;

FIG. 15 is a section taken substantially along the line 15—15 of FIG. 14;

FIG. 16 is a right side view of the pad type clamp half of FIG. 14;

FIG. 17 is a right side view of an alternative pad type clamp half similar to FIG. 16; and FIG. 18 is a view similar to FIG. 14 illustrating the tooth gripping mechanism.

DETAILED DESCRIPTION

Figures 1, 3, 4:
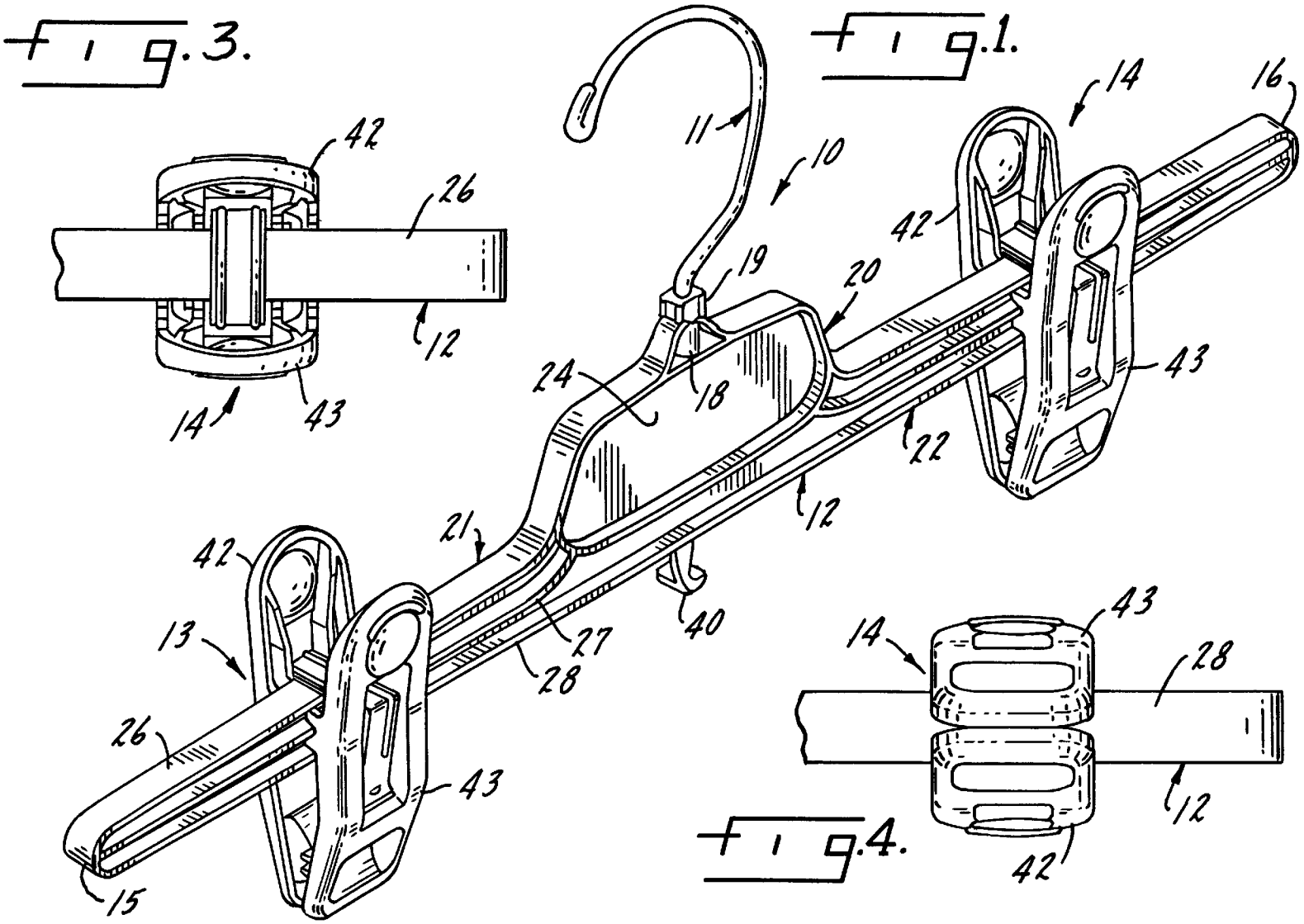
FIG. 1 is a perspective view of the garment hanger of this invention.
FIG. 3 is a partial top plan.
FIG. 4 is a partial bottom plan.
Figure 2:
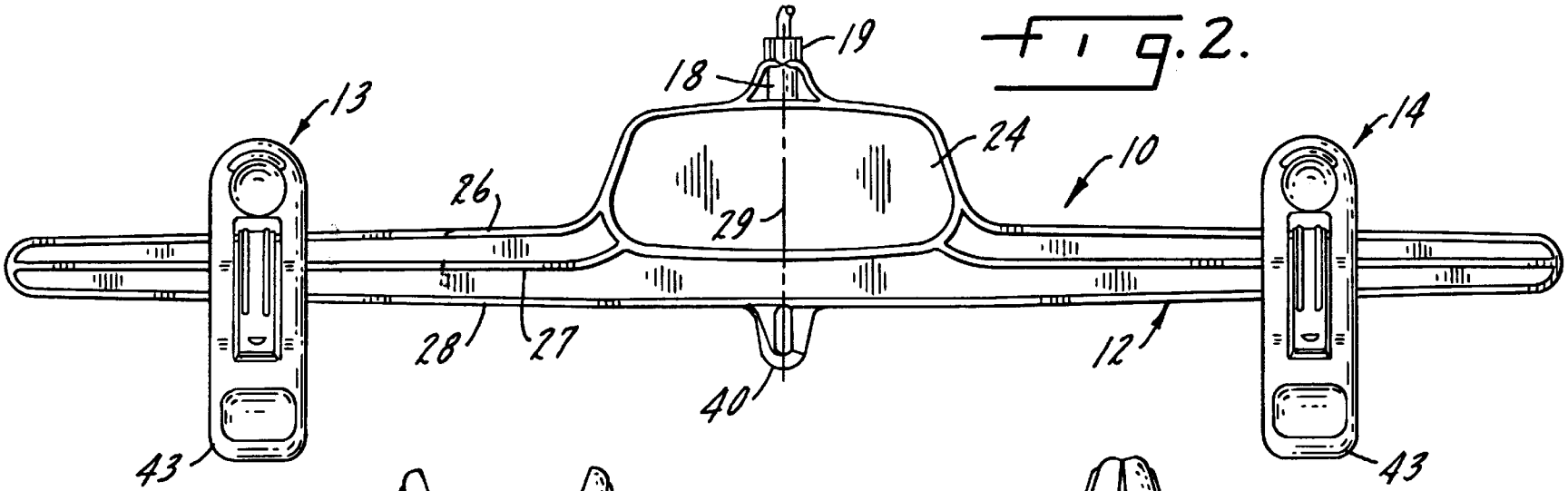
FIG. 2 is a side elevation.

Like reference numerals will be used to refer to like or similar parts from Figure to Figure in the following detailed description of the invention.

Referring first primarily to FIGS. 1–4, the garment hanger assembly of this invention is indicated generally at 10 in FIGS. 1, 2, 3 and 4. The hanger assembly includes a hook assembly, indicated generally at 11, a body or suspension bar indicated generally at 12, and two clamp assemblies, indicated generally at 13, 14, one clamp assembly being associated with each end portion 15, 16 of the suspension bar 12.

The hook assembly 11 is, in this instance a wire hook which is formed separately from the body assembly 12 as clearly appears in FIG. 1. The invention is not limited to the wire hook type of construction however. The base of the wire which forms the hook is anchored in a hook collar 18 which in this instance is formed by and integral with the center of the suspension bar 12. A sizer is illustrated, in this instance, at 19, said sizer being of the collar type. Again the invention is not limited to a collar type sizer.

The suspension bar includes an expanded center section indicated generally at 20, from which a left arm, indicated generally at 21, and a right arm, indicated generally at 22, extend in opposite directions. The center section 20 is, in this instance, formed with an upwardly projecting flat plate-like surface 24 which, here, is generally rectangularly shaped. The center plate 24 is so contoured as to be capable of receiving and displaying a label should a label be required by the retailer.

Figure 6:
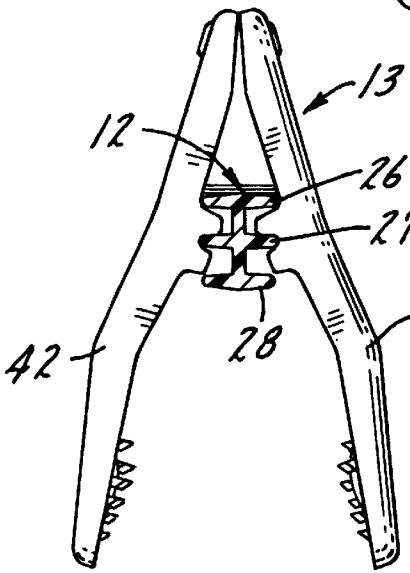
FIG. 6 is a side view of a clamp in an open position.

The cross section shape of each of the left and right arms 21 and 22 is that of an I-beam as appears most clearly in FIGS. 1 and 6. Referring specifically to left arm 21, said arm includes a top horizontal flange 26, a center horizontal web 27, and a bottom horizontal flange 28. From FIGS. 1 and 2 it will be noted that flanges 26 and 28 converge toward one another in an outward direction, using the central vertical axis 29 of collar 18 as a reference point, see FIG. 2. Outer abutment means is indicated at 30, the purpose of which is to limit the outward travel of left clamp assembly 13 as will be more fully described hereinafter, and to prevent the disengagement of left clamp assembly 13 from the left arm 21. The left side 25 of the center section 20 of the suspension bar 12 limits inward movement of the left clamp assembly 13. By reference to FIGS. 5 and 6 it will be noted that bottom flange 28 provides a spaced support point for the left clamp assembly 13 so as to preclude wobble of the clamp assembly about the suspension bar 12, thereby ensuring that the clamp assembly will always be oriented vertically, and therefore any garment hung from the hanger assembly will hang true from the assembly so that the garment is displayed to optimum advantage to the consumer.

An optional coordinate loop is indicated at 40.

Figure 5:
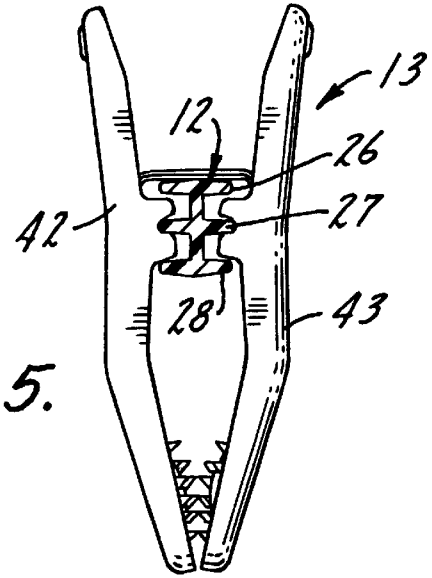
FIG. 5 is a side view of a clamp in a closed condition.

The clamp assemblies 13 and 14 are shown in their closed and opened positions in FIGS. 5 and 6 respectively, from which it will be seen that left clamp assembly 13 consists essentially of three parts, namely a left side 42, right side 43 and a means for biasing the left and right sides toward one another in order to exert a clamping force on a garment which is suspended from the clamp, here a spring 44.

From FIGS. 5 and 6 it will be noted that for a given size clamp assembly and the illustrated three flange construction of the contour shown, the size of opening between the bottom ends of the left and right sides 42 and 43 of the clamp assembly 13 is maximized when the assembly is pivoted around the center horizontal flange 27 as best seen in FIGS. 5 and 6. Such a maximum opening makes possible the reception of bulky garments, such as sweat pants or heavy work clothes while, at the same time, accommodating ladies undergarments of very thin material as can be visualized from FIG. 5. At the same time the drop length of the clamp, that is, the distance between the bottom flange 28 and the bottom of the clamp assembly, is increased over the distance which would be available if the clamp assembly were suspended from the top flange 26. Thus the entire practical range of movement is provided. At the same time the clamp assembly has increased stability as contrasted to the condition which would exist if the clamp assembly were suspended from the top flange 26. With increased stability comes the benefit of more stable absolutely vertical orientation so that, when a garment is attached to the clamp assemblies, the garment will hang straight (because the clamp assemblies will not tilt or cant) and therefore the presentation of the garment to the eye of a potential purchaser will be improved. In addition, the pivoting of the clamp assembly about the center flange 27 instead of the top flange 26 provides more bite on the garment by the clamp. And finally, the suspension of the clamp assembly from the center flange 27 as contrasted to suspension from either top flange 26 or bottom flange 28 ensures that the clamp assembly will always travel parallel to the ground as it slides back and forth on left arm 21 so that there is no possibility of the clamp assembly, and thereby the garment, canting or wobbling throughout its range of movement due to the positive and negative inclinations of the top and bottom flanges 26 and 28 from the horizontal. This benefit is particularly noticeable when small garments are to be suspended and the clamp assemblies consequently moved closer to the center line 29. Specifically, as the clamp assemblies approach the center 29 on top flange 26, the gripping capacity of the clamp assembly is decreasing due to the vertically upward component of movement of the bottom of the clamp assembly attributable to the upwardly increasing incline of the top flange 26 as the center 29 is approached.

The end result is a near maximally advantageous presentation of the garment to the potential purchaser irrespective of the size of garment.

An alternative embodiment of the invention is illustrated in FIGS. 7–18 in which the reference numerals assigned to parts which are the same or similar to corresponding parts in the embodiment of FIGS. 1–6 have been identified with the same reference number, increased by 100.

Referring first primarily to FIGS. 7–10, the garment hanger assembly of this alternative embodiment is indicated generally at 110 in FIGS. 7, 8, 9 and 10. The hanger assembly includes a hook assembly, indicated generally at 111, a body or suspension bar indicated generally at 112, and two clamp assemblies, indicated generally at 113, 114, one clamp assembly being associated with each end portion 115, 116 of the suspension bar 112.

Figures 7, 11, 12, 13:
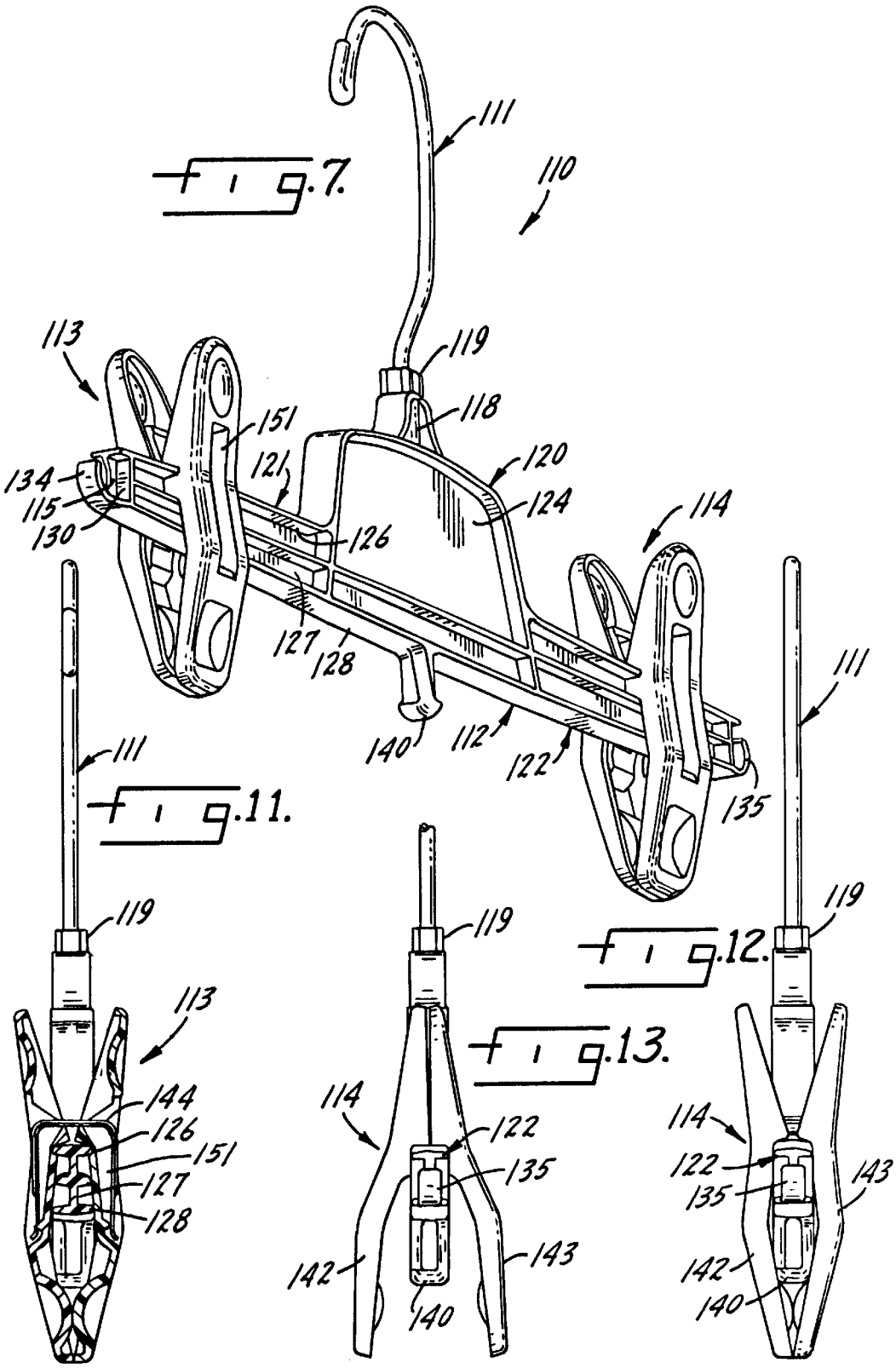
Figures 8, 9, 10:
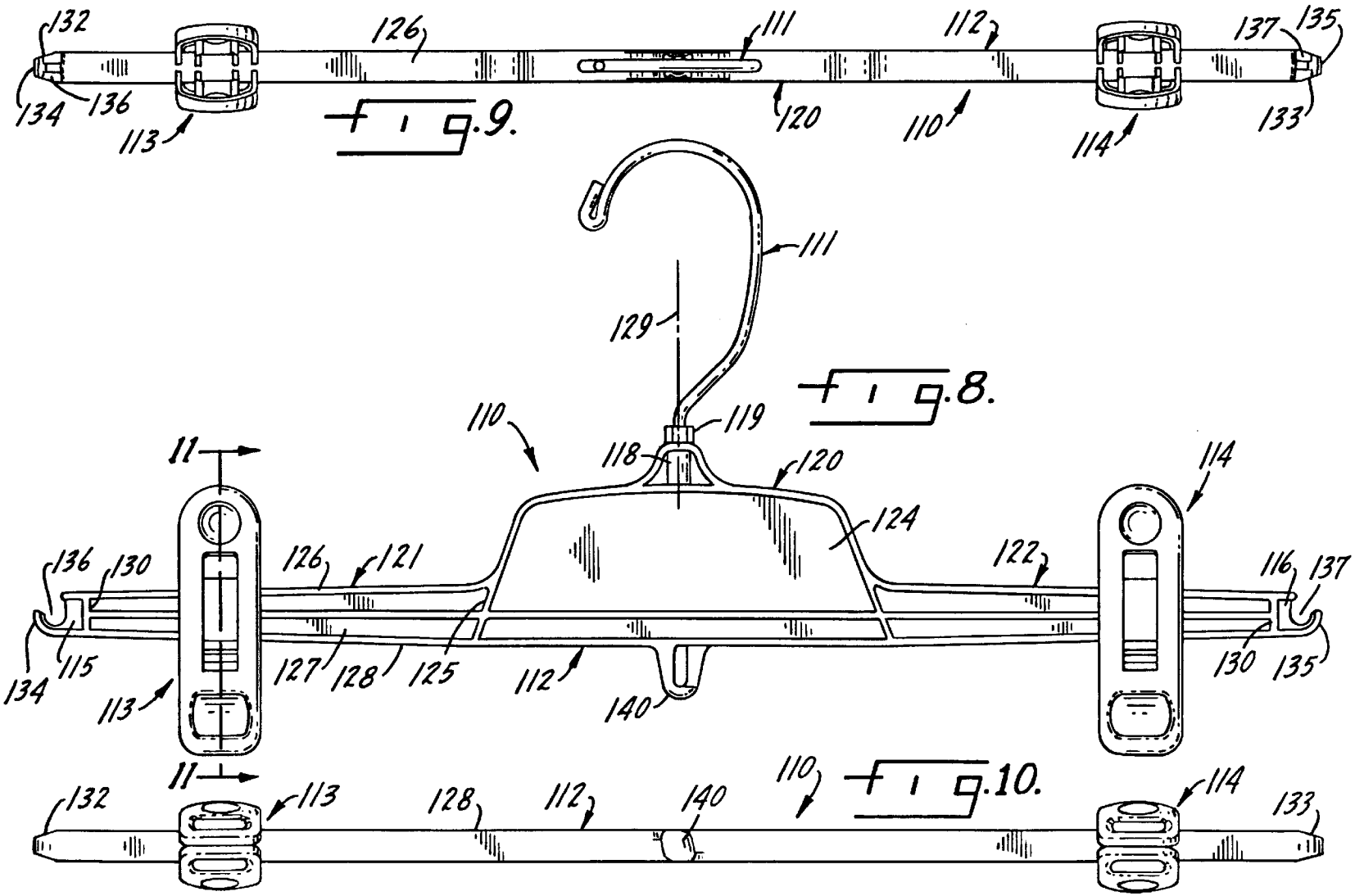

The hook assembly 111 is a wire hook which is formed separately from the body assembly 112 as clearly appears in FIGS. 7 and 8. The invention is not limited to the wire hook type of construction however. The base of the wire which forms the hook is anchored in a hook collar 118 which in this instance is formed by and integral with the center of the suspension bar 112. A sizer is illustrated, in this instance at 119, said sizer being of the collar type. Again the invention is not limited to a collar type sizer.

The suspension bar includes an expanded center section indicated generally at 120, from which a left arm, indicated generally at 121, and a right arm, indicated generally at 122, extend in opposite directions. The center section 120 is, in this instance, formed with an upwardly projecting flat plate-like surface 124 which, here, is generally rectangularly shaped. The center plate 124 is so contoured as to be capable of receiving and displaying a label should a label be required by the retailer.

The cross section shape of each of the left and right arms 121 and 122 is that of an I-beam as appears most clearly in FIGS. 7 and 11. Referring specifically to left arm 121, said arm includes a top horizontal flange 126, a center vertical web 127, and a bottom horizontal flange 128. From FIGS. 7 and 11 it will be noted that webs 126 and 128 converge toward one another in an outward direction, using the central vertical axis 129 of collar 118 as a reference point, see FIG. 8, though it is not essential that such a taper be present. An outer abutment member is indicated at 130, the purpose of which is to limit the outward travel of left clamp assembly 113 as will be more fully described hereinafter, and to prevent the disengagement of left clamp assembly 113 from the left arm 121. The left side 125 of the center section 120 of the suspension bar 112 limits inward movement of the left clamp assembly 113. By reference to FIG. 11 it will be noted that bottom flange 128 provides a spaced support point for the left clamp assembly 113 so as to preclude wobble of the clamp assembly about the suspension bar 112, thereby ensuring that the clamp assembly will always be oriented vertically, and therefore any garment hung from the hanger assembly will hang true from the assembly so that the garment is displayed to optimum advantage to the consumer. To achieve this function however it will be noted that the mid-section 148 of the sides of the clamp must be increased in thickness which, obviously requires the presence of additional material.

From FIGS. 7, 9 and 10 it will be seen that the outermost end portions 132, 133 are tapered slightly inwardly toward the longitudinal horizontal axis of the suspension bar. It will also be noted that suspension bar 112 is provided with hooks 134, 135 at its respective left and right ends to receive garment straps. It will be noted that the open maws 136, 137 of the hooks 134, 135 are open from approximately the 12 o'clock to 2 o'clock, or 12 o'clock to 10 o'clock, positions for the dual purposes of providing quick and easy access by the straps of a garment to be hung from the hanger assembly, and also, to permit the clamp assemblies 113, 114 to be easily assembled to the suspension bar 112 from the extreme ends thereof.

A coordinate loop is indicated at 140.

The clamp assemblies 113 and 114 are shown in their closed and opened positions in FIGS. 12 and 13 respectively, and the construction details of the clamp assemblies are shown best in FIGS. 14–18.

Referring first to FIGS. 12 and 13 it will be seen that right clamp assembly 114 consists essentially of three parts, namely a left side 142, right side 143 and a means for biasing the left and right sides toward one another in order to exert a clamping force on a garment which is suspended from the clamp, here a spring 144.

Figure 15:
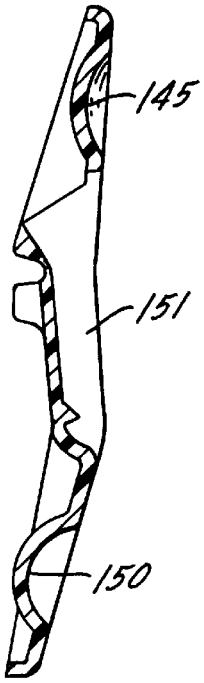
Figure 14:
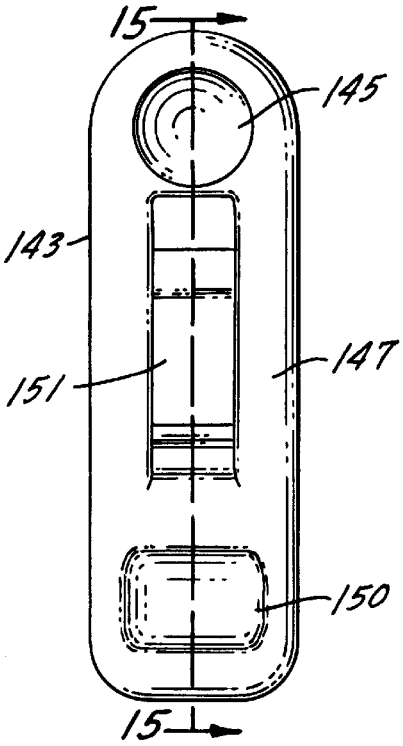
Figure 16:
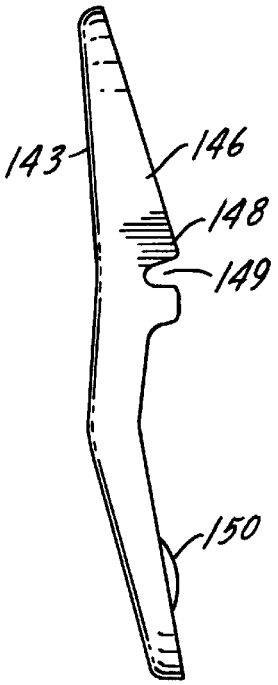

Referring now to FIGS. 14-16 initially, it will be seen that right side 143 consists of a peripheral wall 146 and a plate portion 147 with a finger gripping depression 145 formed in upper end of the plate portion. The peripheral wall increases in depth toward its mid-section, as indicated at 148, and a flange seating notch 149 is formed in said mid-section. It will be noted that the edges of the top horizontal flange 126 and the seat of notch 149 are complementarily contoured so that the clamp side can rotate, or more accurately rock, about the edge of the top horizontal flange during opening and closing movement. The bottom of the clamp side has an inwardly facing bulge formed therein as at 150 for the reception of a garment contacting gripping mechanism, such as a pad of high friction material.

The upper end of the clamp half has a depression 151 formed therein to receive one of the two legs of a generally inverted U-shaped biasing member, such as a metal spring, which, when inserted in an oppositely disposed clamp half, urges that portion of each of the clamp halves beneath the notches 149 toward one another.

Figure 17:
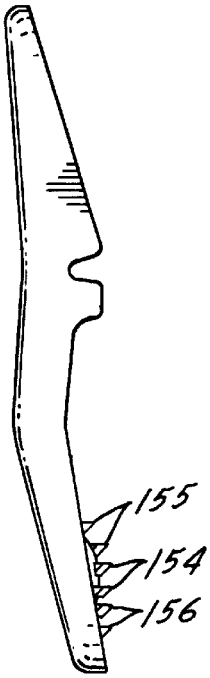
Figure 18:
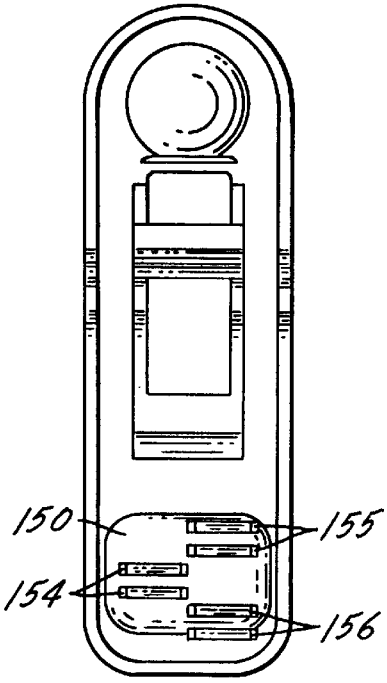

Referring now to FIGS. 17 and 18, it will be noted that the components are identical to the embodiment illustrated in FIGS. 14–16 with the exception that in the embodiment of FIGS. 17 and 18 the provision of a gripping pad has been replaced by a series of offset plastic teeth, a left set being indicated at 154 and two right sets being indicated at 155, 156.

Although a specific example, and several modifications thereof, have been illustrated and described, it will at once be apparent to those skilled in the art that modifications to the basic inventive concept may be made within the spirit and scope of the invention. Hence the scope of the invention should only be limited by the scope of the hereafter appended claims when interpreted in light of the relevant prior art.

What is claimed is:

1. In combination in a garment hanger assembly, a suspension member, hang means projecting upwardly from the suspension member to thereby hang the hanger assembly from a support location, at least one clamp assembly, said clamp assembly being secured to the suspension member by resilient biasing means, said clamp assembly having two opposing jaws having lower ends which are engageable and disengageable from an article to be suspended from the hanger assembly, each jaw of said clamp assembly being a lever having a fulcrum with a bearing surface and stabilizing means for holding said clamp assembly in a vertical position and limiting wobble of said clamp assembly said suspension member having a flange in contact with said bearing surface, and said suspension member having a recess above said flange and another recess below said flange for receiving said stabilizing means, said jaws of said clamp assembly and said biasing means being moveable by hand applied pressure, while in engagement with the suspension member, along the suspension member to an infinite number of locations along said suspension member, abutment members on said suspension member defining said locations.

2. The garment hanger assembly of claim 1 further characterized in that said flange is disposed along a top portion of said suspension member and the clamp assembly pivots about said flange, and said stabilizing means including a protrusion on at least one of said jaws extending inwardly toward said suspension member, one of said recesses being adjacent to said flange and said protrusion being slidable in said recess.

3. The garment hanger assembly of claim 1 further characterized in that said flange is disposed alone a central portion of said suspension member and the clamp assembly pivots about said flange, and said stabilizing means including a protrusion on at least one of said jaws extending inwardly toward said suspension member, one of said recesses being adjacent to said flange and said protrusion being slidable in said recess.

4. The garment hanger assembly of claim 2 further characterized by and including loop receiving means at the end portions of the suspension member, said loop receiving means including an upwardly open maw.

5. The garment hanger assembly of claim 6 further including means for blocking inward movement of the clamp assembly toward the center of the hanger assembly at the extreme inward limit of movement of the clamp assembly with respect to the suspension member.

6. The garment hanger assembly of claim 1 further characterized in that the suspension member includes an elongated structural member extending outwardly from the central portion of the hanger assembly, the elongated structural member comprising a generally horizontal member of uniform width throughout the range of movement of the clamp assembly with respect to the suspension member, the clamp assembly having two opposed portions and means for biasing said opposed portions toward one another, each opposed portions of the clamp assembly having a section adapted to receive an edge of the elongated structural member, said clamp assembly, when said opposed portions thereof are in biased engagement with the elongated structural member, being slidable by pressure applied by hand to the clamp assembly along the elongated structural member throughout the range of movement of the clamp assembly with respect to the elongated structural member.

7. The garment hanger assembly of claim 6 further characterized firstly, in that the elongated structural member includes a second generally horizontal member, said second generally horizontal member being spaced above the first generally horizontal member, and secondly, in that each opposed portion of the clamp assembly has a second section adapted to receive and make sliding contact with the second generally horizontal member on the suspension member whereby the clamp assembly is secured to the suspension member at two vertically spaced locations so as to ensure that the clamp assembly is always maintained in an upright, vertical position and thereby a garment hung from the clamp assembly will always hang true.

8. The garment hanger assembly of claim 6 further characterized in that the means for assembling the clamp assembly to the suspension member includes a narrowed extreme end portion of the suspension member whereby the smaller width end of the suspension member fits easily and loosely into the complementarily engaging portion of the clamp assembly.

9. The garment hanger assembly of claim 8 further including loop receiving means at the end portions of the suspension member, said loop receiving means including an upwardly open maw, and further characterized in that the outermost edge of the upwardly open maw is at a lower elevation than the innermost edge of the maw to thereby preclude catching the clamp assembly as it is assembled to the suspension member.

10. A garment hanger comprising:

a suspension member including at least one laterally extending support arm, said suspension member having at least one flange and at least one recess extending along said support arm above said flange and one recess below said flange, a hook projecting upwardly from the suspension member to thereby hang said hanger from a support location, at least one clamp, said clamp being secured to the suspension member by resilient clip, said clamp having two opposing jaws having lower ends which are engageable and disengageable from an article to be suspended from the hanger, each jaw of said clamp having a fulcrum with a bearing surface in contact with said at least one flange, and each jaw having a stabilizing protrusion extending inwardly from said jaw into said recesses and substantially filling a cross-sectional portion of said recess, whereby said stabilizing protrusion holds said clamp assembly in a vertical position and limits wobble of said clamp about said arm, said jaws of said clamp and said clip being moveable by hand applied pressure, while in engagement with the suspension member, on said flange to an infinite number of locations along said arm, said locations being between abutment members on said suspension member.

* * * * *